US009261830B2

(12) United States Patent
Sakaguchi et al.

(10) Patent No.: US 9,261,830 B2
(45) Date of Patent: Feb. 16, 2016

(54) IMAGE-FORMING APPARATUS FOR CONTROLLING SPEED OF FAN BASED ON DETECTED TEMPERATURE

(71) Applicant: BROTHER KOGYO KABUSHIKI KAISHA, Nagoya-shi, Aichi-ken (JP)

(72) Inventors: Shintaro Sakaguchi, Nagoya (JP); Kaoru Suzuki, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/594,560

(22) Filed: Jan. 12, 2015

(65) Prior Publication Data

US 2015/0198918 A1 Jul. 16, 2015

(30) Foreign Application Priority Data

Jan. 16, 2014 (JP) ..... 2014-005985

(51) Int. Cl.
*G03G 15/20* (2006.01)

(52) U.S. Cl.
CPC ..... *G03G 15/2039* (2013.01); *G03G 15/2017* (2013.01)

(58) Field of Classification Search
CPC ..... G03G 15/2039; G03G 15/205
USPC ..... 399/69, 70
See application file for complete search history.

(56) References Cited

U.S. PATENT DOCUMENTS

| | | | | |
|---|---|---|---|---|
| 5,307,132 | A | 4/1994 | Tsuchiya | |
| 5,920,749 | A * | 7/1999 | Sugaya et al. | 399/69 |
| 7,187,883 | B2 * | 3/2007 | Sato | 399/69 |
| 7,933,530 | B2 * | 4/2011 | Cook et al. | 399/69 |
| 2003/0219274 | A1 | 11/2003 | Hirose et al. | |
| 2009/0208237 | A1 | 8/2009 | Yasuda | |

FOREIGN PATENT DOCUMENTS

| | | | |
|---|---|---|---|
| JP | 1-128073 | A | 5/1989 |
| JP | 2002-132085 | A | 5/2002 |
| JP | 2003-263067 | A | 9/2003 |
| JP | 2003-345224 | A | 12/2003 |
| JP | 2005-148105 | A | 6/2005 |
| JP | 2008-242488 | A | 10/2008 |
| JP | 2009-180917 | A | 8/2009 |

* cited by examiner

*Primary Examiner* — William J Royer
(74) *Attorney, Agent, or Firm* — Merchant & Gould PC

(57) ABSTRACT

In an image-forming apparatus an image-forming portion performs a printing operation in which an image is formed on a sheet. A heater thermally fixes the image on the sheet. A processor is configured to: determine whether a temperature detected by a detector is higher than a threshold value before the image-forming portion performs the printing operation; drive a fan at a first speed following start of the printing operation when the temperature is higher than the threshold value; and drive the fan at a second speed lower than the first speed for a prescribed period of time following the start of the printing operation when the temperature is lower than the threshold value or equal to the threshold value, and subsequently drive the fan at the first speed; control a temperature of the heater based on the temperature detected by the detector while the image-forming portion performs the printing operation.

17 Claims, 8 Drawing Sheets

IMAGE-FORMING APPARATUS FOR CONTROLLING SPEED OF FAN BASED ON DETECTED TEMPERATURE

CROSS REFERENCE TO RELATED APPLICATION

This application claims priority from Japanese Patent Application No. 2014-005985 filed Jan. 16, 2014. The entire content of the priority application is incorporated herein by reference.

TECHNICAL FIELD

The present invention relates to a technique for controlling a cooling fan used to cool the interior of an image-forming apparatus.

BACKGROUND

Japanese Patent Application Publication No. 2005-148105 discloses a technique for controlling the internal temperature of an image-forming apparatus. This image-forming apparatus uses a built-in temperature sensor for detecting the internal temperature and fan control based on the detected temperature data.

SUMMARY

However, when using a fan to cool the interior of an image-forming apparatus based on temperature data detected with a built-in sensor, as in the conventional device described above, the fan operation may also affect the temperature in a fixing unit, potentially leading to problems in the fixing operation.

In view of the foregoing, it is an object of the present invention to provide a technique for controlling the fan in an image-forming apparatus based on detection results from a temperature-detecting unit that detects the temperature in the fixing unit of the image-forming apparatus.

In order to attain the above and other objects, the invention provides an image-forming apparatus. The image-forming apparatus includes a fan, an image-forming portion, a heater, a detector, and a processor. The image-forming portion is configured to perform a printing operation in which an image is formed on a sheet. The heater is configured to thermally fix the image on the sheet. The detector is configured to detect a temperature of the heater. The processor is configured to: determine whether the temperature detected by the detector is higher than a threshold value before the image-forming portion performs the printing operation; drive the fan at a first speed following start of the printing operation when the temperature is higher than the threshold value; and drive the fan at a second speed lower than the first speed for a prescribed period of time following the start of the printing operation when the temperature is lower than the threshold value or equal to the threshold value, and subsequently drive the fan at the first speed; control a temperature of the heater based on the temperature detected by the detector while the image-forming portion performs the printing operation.

According to another aspect, the present invention provides an image-forming apparatus. The image-forming apparatus includes a fan, an image-forming portion, a heater, a non-contact temperature detector, and a processor. The fan is configured to drive at a first speed and a second speed that is lower than the first speed. The image-forming portion is configured to perform a printing operation in which an image is formed on a sheet. The heater is configured to heat the image on the sheet. The non-contact temperature detector is configured to detect a temperature of the heater without contact. The processor is configured to: drive the fan at the second speed for a prescribed period of time following the start of the printing operation and subsequently drive the fan at the first speed; obtain the temperature detected by the non-contact temperature detector when the fan drives; and control a temperature of the heater based on the obtained temperature.

According to another aspect, the present invention provides an image-forming apparatus. The image-forming apparatus includes a fan, an image-forming portion, a heater, a detector, a memory, and a processor. The fan is configured to drive at a first speed or a second speed that is slower than the first speed. The image-forming portion is configured to perform a printing operation in which an image is formed on a sheet. The heater is configured to heat the image on the sheet. The detector is configured to detect a temperature of the heater. The memory is configured to store a temperature correction formula. The processor is configured to: obtain a speed of the fan; obtain a temperature correction formulae from the memory based on the speed of the fan; correct the temperature to a corrected temperature by using an obtained temperature correction formulae; and control a temperature of the heater based on the corrected temperature.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
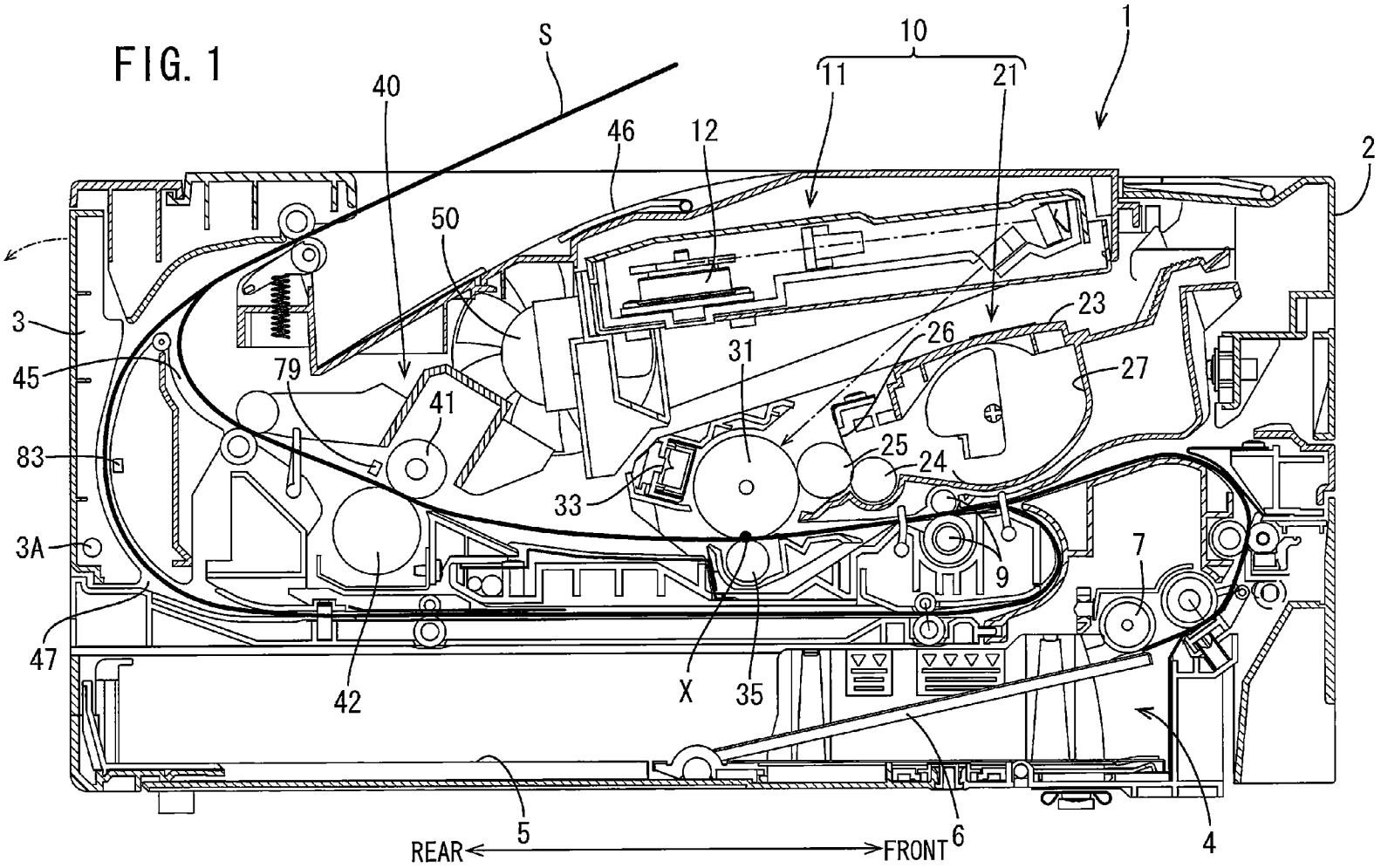
FIG. 1 is a side cross-sectional view of a printer according to a first embodiment of the present invention.

A printer 1 according to a first embodiment of the invention will be described while referring to FIGS. 1-5B. FIG. 1 is a side cross-sectional view showing the relevant components of the printer 1. The printer 1 (an example of an image-forming apparatus) includes a device frame 2 (casing), a sheet-feeding unit 4, an image-forming unit 10, a fixing unit 40, and a fan 50. In the following explanations, the right side of FIG. 1 will be referred to as a front side, and the left side of FIG. 1 will be referred to as a rear side.

The sheet-feeding unit 4 includes a paper tray 5 that holds sheets S of a printing paper, a lifting plate 6, and a feeding roller 7. The lifting plate 6 is capable of pivoting about its rear edge and presses the sheets S resting on top of the lifting plate 6 toward the feeding roller 7. The feeding roller 7 can rotate to feed sheets S one at a time onto a conveying path.

A sheet S fed by the feeding roller 7 follows the conveying path downstream to a pair of registration rollers 9. The registration rollers 9 first correct skew in the sheet S relative to the conveying direction and then convey the sheet S to a transfer position X. The transfer position X is the position at which a photosensitive drum 31 contacts a transfer roller 35 and at which a toner image carried on the photosensitive drum 31 is transferred to the sheet S.

An image-forming unit 10 functions to form a toner image on the sheet S. The image-forming unit 10 includes a scanning unit 11, and a process unit 21. The scanning unit 11 has a laser light-emitting unit (not shown), a polygon mirror 12, and the like. The laser light-emitting unit emits a laser beam (depicted by a chain line in FIG. 1) that is deflected off the polygon mirror 12 and irradiated onto the surface of the photosensitive drum 31.

The process unit 21 includes a developing cartridge 23, the photosensitive drum 31, and a scorotron charger 33.

The developing cartridge 23 includes a supply roller 24, a developing roller 25, and a blade 26. A toner-accommodating chamber 27 is also formed inside the developing cartridge 23 for accommodating toner as an example of a developer.

The supply roller 24 supplies positively charged toner from the toner-accommodating chamber 27 onto the surface of the developing roller 25. The developing roller 25 supplies the positively charged toner onto the surface of the photosensitive drum 31.

The scorotron charger 33 applies a uniform positive charge to the surface of the photosensitive drum 31. The laser beam emitted from the scanning unit 11 exposes the positively charged surface of the photosensitive drum 31 to form an electrostatic latent image thereon. Next, the toner carried on the surface of the developing roller 25 is supplied to the latent image formed on the photosensitive drum 31 for developing the latent image.

The fixing unit 40 includes a heating roller 41, and a pressure roller 42. The fixing unit 40 thermally fixes a toner image to a sheet S when the sheet S passes between the heating roller 41 and the pressure roller 42. After the toner image has been thermally fixed to the sheet S, the sheet S is conveyed along a discharge path 45 and discharged onto a discharge tray 46.

The printer 1 also includes a re-conveying path 47 disposed beneath the discharge path 45 for conveying a sheet S back to the image-forming unit 10 after an image has been formed on one side of the sheet S in order to form an image on the other side.

The fan 50 is provided on a side wall of the device frame 2. More specifically, the fan 50 is disposed between the fixing unit 40 and the image-forming unit 10 with respect to the front-rear direction (left-right direction in FIG. 1). The fan 50 functions to lower the internal temperature of the printer 1 by exhausting air in the device frame 2 out of the device frame 2 through a vent (not shown).

The printer 1 is also provided with a rear cover 3 disposed on the rear wall of the device frame 2. The rear cover 3 can be opened and closed by pivoting about a cover shaft 3A on the rear side of the device frame 2 near the bottom thereof. An opening in the rear side of the device frame 2 is exposed when the rear cover 3 is opened, enabling the user to gain access to the interior of the device frame 2.

Figure 2:
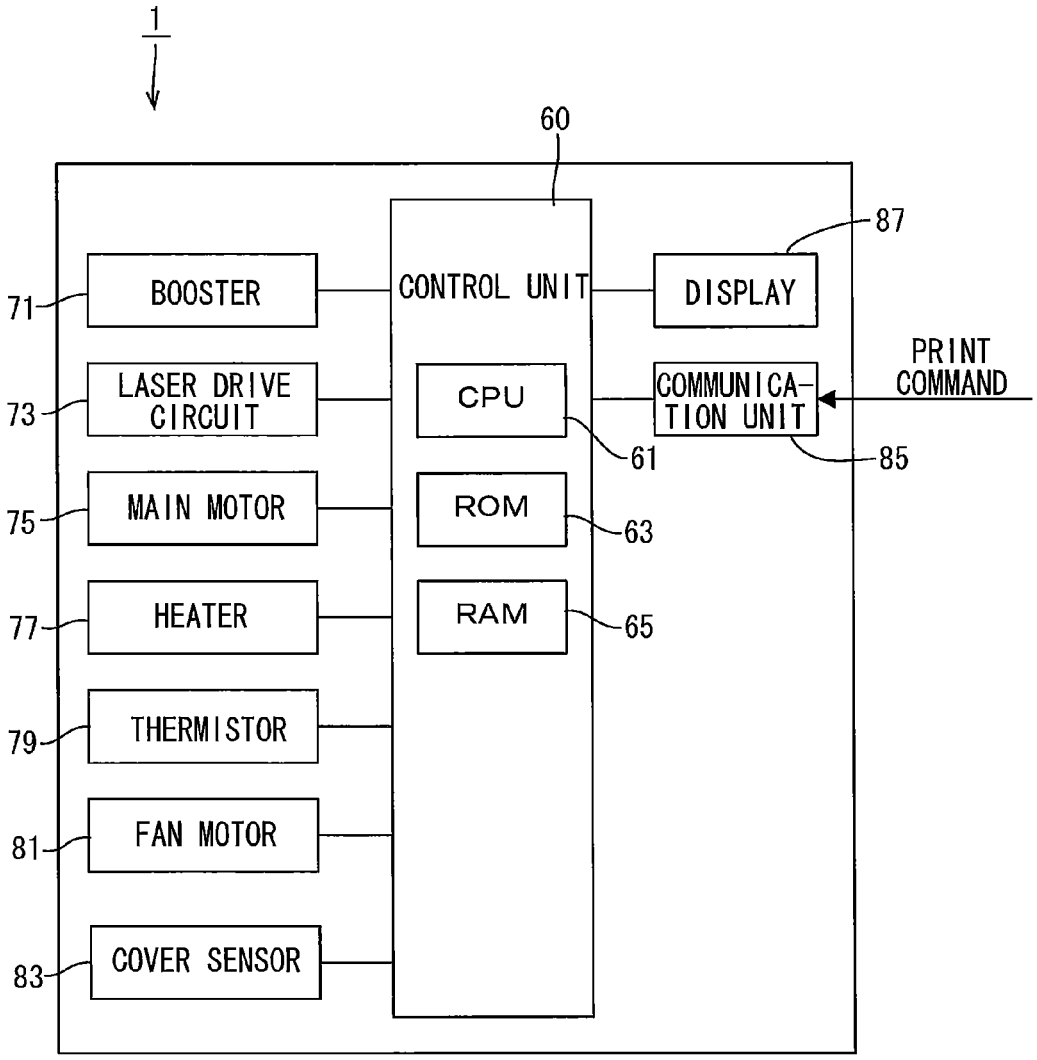
FIG. 2 is a block diagram showing an electrical structure of the printer according to the first embodiment.

FIG. 2 is a block diagram showing the electrical structure of the printer 1. In its electrical configuration, the printer 1 includes a control unit 60, a booster 71, a laser drive circuit 73, a main motor 75, a heater 77, a thermistor 79, a fan motor 81, a cover sensor 83, a communication unit 85, and a display 87. The thermistor 79 is an example of the temperature-detecting unit and temperature sensor in the invention.

The booster 71 generates a high voltage to be applied to the scorotron charger 33, the developing roller 25, and the transfer roller 35. The laser drive circuit 73 supplies electricity to the laser light-emitting unit.

The main motor 75 drives the rotation of rotary bodies in the process unit 21, such as the photosensitive drum 31 and the developing roller 25; and the rotary bodies in the paper-conveying system, such as the feeding roller 7 and the registration rollers 9.

The heater 77 is built into the heating roller 41 for heating the same. The thermistor 79 is disposed in proximity to the heating roller 41 for detecting the surface temperature of the heating roller 41 without contact. The thermistor 79 provides feedback for regulating the surface temperature of the heating roller 41 to a target value. The fan motor 81 functions to rotate the fan 50. The cover sensor 83 detects when the rear cover 3 is opened and closed.

The communication unit 85 functions to exchange data with a data terminal device. The display 87 is configured of a liquid crystal panel and displays various data in response to commands from the control unit 60.

The control unit 60 includes a CPU 61, a ROM 63, and a RAM 65. The CPU 61 functions to control the image-forming unit 10, to regulate the temperature of the fixing unit 40, and to control the fan 50.

The ROM 63 stores various programs, and data that the CPU 61 references when executing various processes based on these programs, such as a temperature correction coefficient $\alpha$, and a temperature correction offset $\beta$. The RAM 65 is used as the main memory when the CPU 61 executes these processes.

The printer 1 has three primary modes, including a print mode, a ready mode, and a sleep mode. The printer 1 is in the print mode when executing a printing process. In the print mode, the control unit 60 regulates the temperature of the fixing unit 40 at a fixing temperature (210° C., for example). In the ready mode, the control unit 60 maintains the fixing unit 40 at a standby temperature (160° C., for example) in order to be able to quickly execute a printing process upon receiving a print command. The printer 1 enters the sleep mode in order to conserve power. In the sleep mode, the control unit 60 maintains the fixing unit 40 in an off state.

The printer 1 according to the first embodiment temporarily shifts to the ready mode after the power has been turned on. Upon receiving a print command, the printer 1 shifts into the print mode to execute the printing process and shifts back to the ready mode after completing the printing process.

If the printer 1 has been in the ready mode for a predetermined time without receiving a print command, the printer 1 enters the sleep mode. Thus, when the printer 1 has been in the ready mode for the predetermined time after the power was turned on or after completing a printing process, the printer 1 then shifts into the sleep mode. If the printer 1 receives a print command while in the sleep mode, the printer 1 shifts into the print mode to execute the printing process, then shifts into the ready mode after completing the printing process.

The printer 1 employs the non-contact thermistor 79 to detect the temperature of the fixing unit 40. A non-contact temperature sensor has an advantage over a contact temperature sensor in that toner or other foreign matter becoming deposited on the surface of the fixing unit 40 will have little effect on the temperature detection results.

Figure 3:
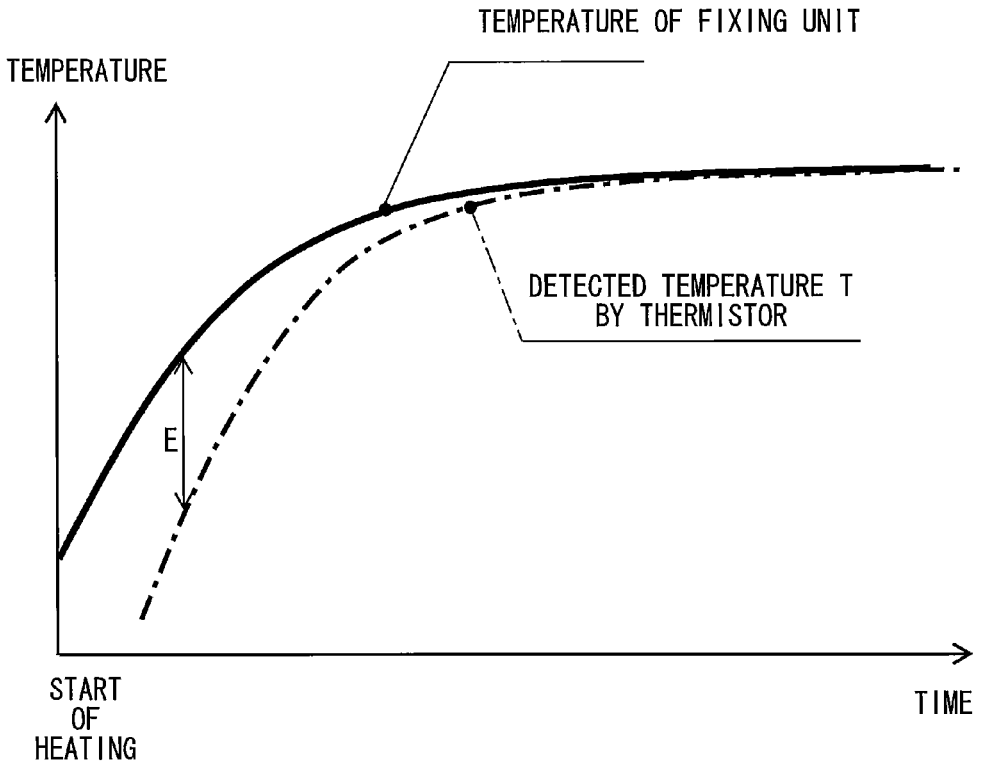
FIG. 3 is a graph illustrating a difference between an actual temperature of a fixing unit and a temperature detected by a thermistor according to the first embodiment.

However, the detection temperature of a non-contact sensor lags behind the actual temperature of the detection target. As shown in the graph of FIG. 3, the detection temperature of the thermistor 79 is lower than the actual temperature of the fixing unit 40 (surface temperature of the heating roller 41)

immediately after the heater 77 begins heating the heating roller 41. Therefore, the control unit 60 corrects the detection temperature T of the thermistor 79 using the temperature correction formula (1) shown below to obtain a corrected temperature Z and uses this corrected temperature Z as feedback for controlling the temperature of the fixing unit 40. This enables the control unit 60 to suppress the lag in temperature detection by the thermistor 79 in order to control the temperature of the fixing unit 40 with high precision.

$$Z=\alpha\times T+\beta \quad (1)$$

Here, α denotes the temperature correction coefficient and β denotes the temperature correction offset.

As shown in FIG. 3, an error E denoting the difference between the detection temperature of the thermistor 79 and the actual temperature of the fixing unit 40 is larger at lower detection temperatures and gradually decreases as time elapses after heating in the fixing unit 40 is started. Accordingly, the printer 1 of the embodiment determines the temperature correction coefficient α and the temperature correction offset β to be used in the temperature correction formula based on the detection temperature of the thermistor 79 at the start of heating and the amount of time elapsed since the start of heating. The values of the temperature correction coefficient α and temperature correction offset β are set so that the lower the detection temperature of the thermistor 79 at the start of heating, the greater the difference between the corrected temperature Z and the detection temperature T. Further, the temperature correction coefficient α and the temperature correction offset β are set so that the greater the amount of time that has elapsed since the start of heating, the smaller the difference between the corrected temperature Z and the detection temperature T.

The printer 1 controls the fan 50 based on the detection temperature of the thermistor 79. When the detection temperature of the thermistor 79 before the start of a printing operation is lower than or equal to a threshold value (150° C., for example), the printer 1 drives the fan 50 at low speed for a prescribed time following the start of the printing operation, then drives the fan 50 at high speed after the prescribed time has elapsed.

However, if the detection temperature is higher than the threshold value, the control unit 60 drives the fan 50 at high speed after the start of the printing operation. Here, "high speed" denotes the maximum speed at which the fan motor 81 can be driven to rotate, while "low speed" denotes one-half the maximum speed, for example.

Next, this fan control process will be described in greater detail with reference to the printer state transition diagram shown in FIG. 4.

When the printer 1 receives a print job while in the sleep mode, in which the control unit 60 is maintaining the fixing unit 40 in its off state, the control unit 60 acquires the detection temperature of the thermistor 79 and corrects this detection temperature using the temperature correction formula Z=1.1×T+2.

Next, the control unit 60 determines which temperature range in which the corrected temperature Z belongs from among the ranges 50° C. or less, 51-100° C., 101-150° C., and 151° C. or greater. A temperature control pattern used by the printer 1 after receiving a print job is set for each of these temperature ranges, as shown in FIG. 4. The printer 1 is controlled according to the control pattern determined based on the corrected temperature Z. Note that the fan 50 is driven at low speed for printer states enclosed in chain lines in FIG. 4, and is driven at high speed for states enclosed in a dashed line. The solid line indicates the printing modes during which the printing process is executed.

The printer 1 transitions from the sleep mode to the warm-up mode state Warm-up A when the corrected temperature Z is less than or equal to 50° C. For Warm-up A, the control unit 60 uses the temperature correction formula Z=1.5×T−6 to correct the detection temperature of the thermistor 79 and executes a warm-up process for increasing the temperature in the fixing unit 40 so that the corrected temperature Z reaches the fixing temperature (210° C., for example). Once the corrected temperature Z has risen to the fixing temperature, the printer 1 transitions to the print mode.

Figure 4:
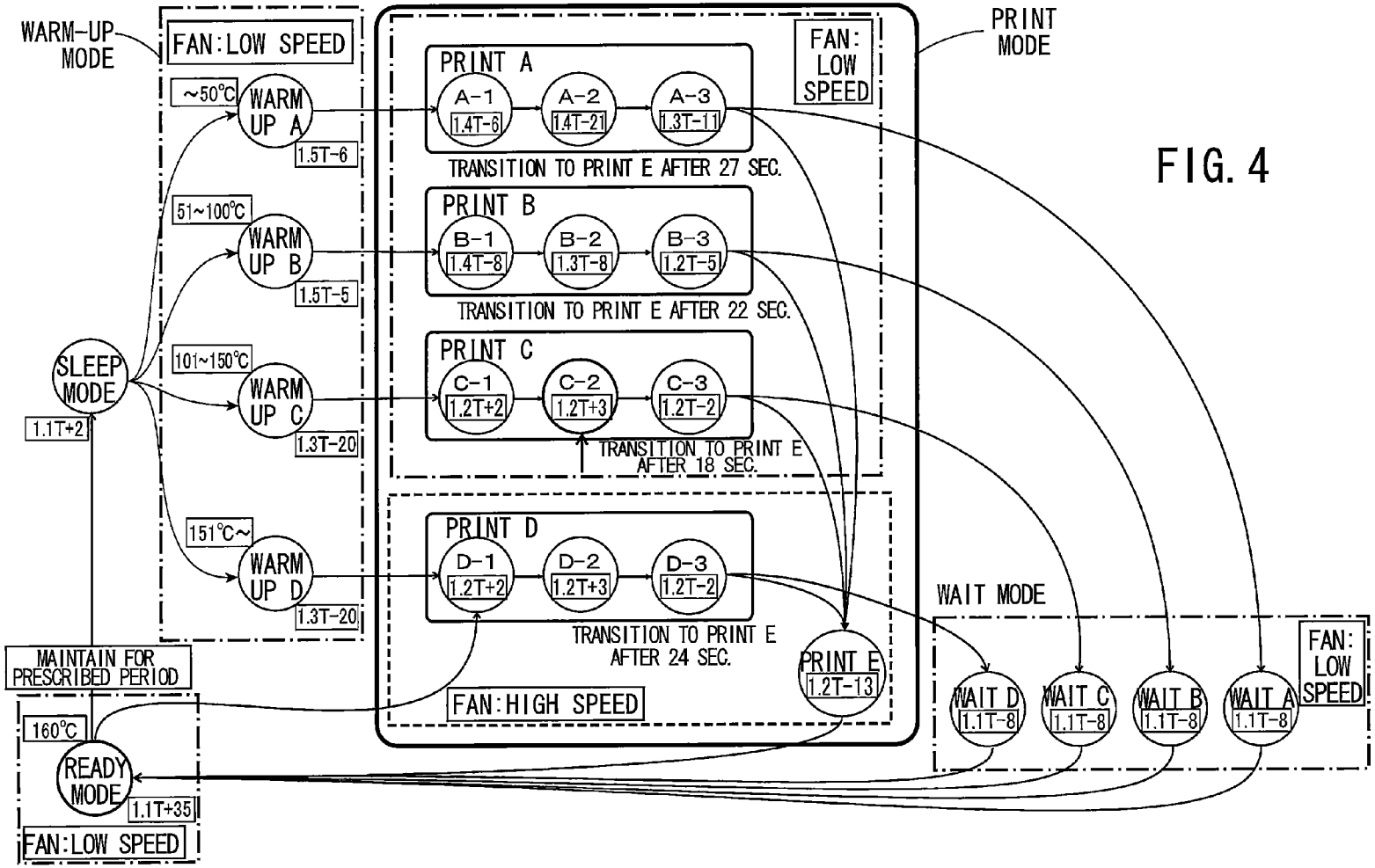
FIG. 4 is a printer state transition diagram according to the first embodiment.

In this example, the printer 1 transitions to the print mode state Print A, as shown in FIG. 4. When transitioning to Print A, the control unit 60 controls the image-forming unit 10 to execute a printing process while continuing to drive the fan 50 at low speed.

Note that Print A includes three states A-1, A-2, and A-3, and the printer 1 transitions among these states in the order A-1→A-2→A-3. These three states differ in the formula that the control unit 60 uses to calculate the corrected temperature Z. Specifically, the control unit 60 uses the temperature correction formula Z=1.4×T−6 for state A-1, the temperature correction formula Z=1.4×T−21 for state A-2, and the temperature correction formula Z=1.3×T−11 for state A-3 to correct the detection temperature of the thermistor 79. The control unit 60 then uses the corrected temperature Z as feedback to control the temperature of the fixing unit 40 in order that the corrected temperature Z can be maintained at the fixing temperature required to thermally fix toner to the sheet S.

The execution time for Print A is set to a duration of 27 seconds. Thus, when 27 seconds have elapsed after transitioning to Print A, the printer 1 transitions from state Print A to state Print E. When the printer 1 enters state Print E, the control unit 60 switches the speed of the fan 50 from low speed to high speed and controls the state at which the printer 1 executes the printing process while driving the fan 50 at high speed. In the print mode state Print E, the control unit 60 uses the temperature correction formula Z=1.2×T−13 to correct the detection temperature of the thermistor 79, and controls the temperature of the fixing unit 40 so that the corrected temperature Z is maintained at the fixing temperature.

After completing the printing process, the printer 1 shifts from the print mode to the ready mode. In the ready mode, the printer 1 enters a standby state to wait for a print command. At this time, the control unit 60 controls the fan 50 at low speed. In the ready mode, the control unit 60 uses the temperature correction formula Z=1.1×T+35 to correct the detection temperature of the thermistor 79, and uses the corrected temperature Z as feedback to control the temperature of the fixing unit 40 so that the corrected temperature Z remains at a standby temperature lower than the fixing temperature (160° C., for example).

Further, if the printer 1 has completed the printing process by the time 27 seconds have elapsed since shifting to state Print A, the printer 1 transitions from state Print A to state Wait A in the wait mode. In Wait A, the control unit 60 uses the temperature correction formula Z=1.1×T−8 to correct the detection temperature of the thermistor 79. Next, the control unit 60 turns the heater 77 off while maintaining the fan 50 at low speed and waits until the corrected temperature Z drops to the standby temperature (160° C., for example), which is lower than the fixing temperature. Once 30 seconds have elapsed after the printing process was completed, the printer 1 transitions to the ready mode. This is because the corrected temperature Z drops generally to the standby temperature sufficiently after 30 seconds.

The printer 1 transitions from the sleep mode to the warm-up mode state Warm-up B when the corrected temperature Z is higher than or equal to 51° C. and less than or equal to 100° C. For Warm-up B, the control unit 60 uses the temperature correction formula Z=1.5×T−5 to correct the detection temperature of the thermistor 79 and executes a warm-up process for increasing the temperature in the fixing unit 40 so that the corrected temperature Z reaches the fixing temperature (210° C., for example). Once the corrected temperature Z has risen to the fixing temperature, the printer 1 transitions to the print mode.

In this case, the printer 1 transitions to the print mode state Print B, as shown in FIG. 4. When transitioning to Print B, the control unit 60 controls the image-forming unit 10 to execute a printing process while continuing to drive the fan 50 at low speed.

Note that Print B includes three states B-1, B-2, and B-3, and the printer 1 transitions among these states in the order B-1→B-2→B-3. These three states differ in the formula that the control unit 60 uses to calculate the corrected temperature Z. Specifically, the control unit 60 uses the temperature correction formula Z=1.4×T−8 for state B-1, the temperature correction formula Z=1.3×T−8 for state B-2, and the temperature correction formula Z=1.2×T−5 for state B-3 to correct the detection temperature of the thermistor 79. The control unit 60 then uses the corrected temperature Z as feedback to control the temperature of the fixing unit 40 in order that the corrected temperature Z can be maintained at the fixing temperature required to thermally fix toner to the sheet S.

The execution time for Print B is set to a duration of 22 seconds. Thus, when 22 seconds have elapsed after transitioning to Print B, the printer 1 transitions from state Print B to state Print E. When the printer 1 enters state Print E, the control unit 60 switches the speed of the fan 50 from low speed to high speed and controls the state at which the printer 1 executes the printing process while driving the fan 50 at high speed.

After completing the printing process, the printer 1 shifts from the print mode to the ready mode. In the ready mode, the printer 1 enters a standby state to wait for a print command. At this time, the control unit 60 controls the fan 50 at low speed.

Further, if the printer 1 has completed the printing process by the time 22 seconds have elapsed since shifting to state Print B, the printer 1 transitions from state Print B to state Wait B in the wait mode. In Wait B, the control unit 60 uses the temperature correction formula Z=1.1×T−8 to correct the detection temperature of the thermistor 79. Next, the control unit 60 turns the heater 77 off while maintaining the fan 50 at low speed and waits until the corrected temperature Z drops to the standby temperature (160° C., for example), which is lower than the fixing temperature. Once 30 seconds have elapsed after the printing process was completed, the printer 1 transitions to the ready mode. This is because the corrected temperature Z drops generally to the standby temperature sufficiently after 30 seconds.

The printer 1 transitions from the sleep mode to the warm-up mode state Warm-up C when the corrected temperature Z is higher than or equal to 101° C. and less than or equal to 150° C. For Warm-up C, the control unit 60 uses the temperature correction formula Z=1.3×T−20 to correct the detection temperature of the thermistor 79 and executes a warm-up process for increasing the temperature in the fixing unit 40 so that the corrected temperature Z reaches the fixing temperature (210° C., for example). Once the corrected temperature Z has risen to the fixing temperature, the printer 1 transitions to the print mode.

In this case, the printer 1 transitions to the print mode state Print C, as shown in FIG. 4. When transitioning to Print C, the control unit 60 controls the image-forming unit 10 to execute a printing process while continuing to drive the fan 50 at low speed.

Note that Print C includes three states C-1, C-2, and C-3, and the printer 1 transitions among these states in the order C-1→C-2→C-3. These three states differ in the formula that the control unit 60 uses to calculate the corrected temperature Z. Specifically, the control unit 60 uses the temperature correction formula Z=1.2×T+2 for state C-1, the temperature correction formula Z=1.2×T+3 for state C-2, and the temperature correction formula Z=1.2×T−2 for state C-3 to correct the detection temperature of the thermistor 79. The control unit 60 then uses the corrected temperature Z as feedback to control the temperature of the fixing unit 40 in order that the corrected temperature Z can be maintained at the fixing temperature required to thermally fix toner to the sheet S.

The execution time for Print C is set to a duration of 18 seconds. Thus, when 18 seconds have elapsed after transitioning to Print C, the printer 1 transitions from state Print C to state Print E. When the printer 1 enters state Print E, the control unit 60 switches the speed of the fan 50 from low speed to high speed and controls the state at which the printer 1 executes the printing process while driving the fan 50 at high speed.

After completing the printing process, the printer 1 shifts from the print mode to the ready mode. In the ready mode, the printer 1 enters a standby state to wait for a print command. At this time, the control unit 60 controls the fan 50 at low speed.

Further, if the printer 1 has completed the printing process by the time 18 seconds have elapsed since shifting to state Print C, the printer 1 transitions from state Print C to state Wait C in the wait mode. In Wait C, the control unit 60 uses the temperature correction formula Z=1.1×T−8 to correct the detection temperature of the thermistor 79. Next, the control unit 60 turns the heater 77 off while maintaining the fan 50 at low speed and waits until the corrected temperature Z drops to the standby temperature (160° C., for example), which is lower than the fixing temperature. Once 30 seconds have elapsed after the printing process was completed, the printer 1 transitions to the ready mode. This is because the corrected temperature Z drops generally to the standby temperature sufficiently after 30 seconds.

The printer 1 transitions from the sleep mode to the warm-up mode state Warm-up D when the corrected temperature Z is higher than or equal to 151° C. For Warm-up D, the control unit 60 uses the temperature correction formula Z=1.3×T−20 to correct the detection temperature of the thermistor 79 and executes a warm-up process for increasing the temperature in the fixing unit 40 so that the corrected temperature Z reaches the fixing temperature (210° C., for example). Once the corrected temperature Z has risen to the fixing temperature, the printer 1 transitions to the print mode.

In this case, the printer 1 transitions to the print mode state Print D, as shown in FIG. 4. When transitioning to Print D, the control unit 60 controls the image-forming unit 10 to execute a printing process while continuing to drive the fan 50 at high speed.

Note that Print D includes three states D-1, D-2, and D-3, and the printer 1 transitions among these states in the order D-1→D-2→D-3. These three states differ in the formula that the control unit 60 uses to calculate the corrected temperature Z. Specifically, the control unit 60 uses the temperature correction formula Z=1.2×T+2 for state D-1, the temperature correction formula Z=1.2×T+3 for state D-2, and the temperature correction formula Z=1.2×T−2 for state D-3 to correct the detection temperature of the thermistor 79. The control unit 60 then uses the corrected temperature Z as feedback to control the temperature of the fixing unit 40 in order that the corrected temperature Z can be maintained at the fixing temperature required to thermally fix toner to the sheet S.

The execution time for Print D is set to a duration of 24 seconds. Thus, when 24 seconds have elapsed after transitioning to Print D, the printer 1 transitions from state Print D to state Print E. When the printer 1 enters state Print E, the control unit 60 maintains the speed of the fan 50 at high speed and controls the state at which the printer 1 executes the printing process while driving the fan 50 at high speed.

After completing the printing process, the printer 1 shifts from the print mode to the ready mode. In the ready mode, the printer 1 enters a standby state to wait for a print command. At this time, the control unit 60 controls the fan 50 at low speed.

Further, if the printer 1 has completed the printing process by the time 24 seconds have elapsed since shifting to state Print D, the printer 1 transitions from state Print D to state Wait D in the wait mode. In Wait D, the control unit 60 uses the temperature correction formula Z=1.1×T−8 to correct the detection temperature of the thermistor 79. Next, the control unit 60 turns the heater 77 off while switching the speed of the fan 50 from high speed to low speed and waits until the corrected temperature Z drops to the standby temperature (160° C., for example), which is lower than the fixing temperature. Once 30 seconds have elapsed after the printing process was completed, the printer 1 transitions to the ready mode. This is because the corrected temperature Z drops generally to the standby temperature sufficiently after 30 seconds.

If the printer 1 receives a print job while in the ready mode, that is, if the printer 1 receives a print job while the control unit 60 is controlling the temperature of the fixing unit 40 at the standby temperature (160° C., for example), the printer 1 transitions from the ready mode to the print mode state Print D, as shown in FIG. 4, and the control unit 60 controls the printer 1 in a state for executing a printing process while driving the fan 50 at high speed. Once 24 seconds have elapsed after the printer 1 has transitioned to Print D, the printer 1 transitions from the state Print D to the state Print E. Once in the state Print E, the control unit 60 controls the printer 1 to execute a printing process while driving the fan 50 at high speed.

After completing the printing process, the printer 1 transitions from the print mode to the ready mode. In the ready mode, the printer 1 remains in a standby state, waiting for a print command, while the control unit 60 controls the fan 50 at low speed.

If the printing process is completed by the time 24 seconds have elapsed after shifting to Print D, the printer 1 shifts from Print D to the wait mode state Wait D. In Wait D, the control unit 60 uses the temperature correction formula Z=1.1×T−8 to correct the detection temperature of the thermistor 79. Next, the control unit 60 switches off the heater 77 while maintaining the fan 50 at low speed and enters a wait state to wait for the corrected temperature Z to drop to a standby temperature lower than the fixing temperature (160° C., for example). When 30 seconds have elapsed after completion of the printing process, the printer 1 shifts to the ready mode. This is because the corrected temperature Z drops generally to the standby temperature sufficiently after 30 seconds.

Figure 5A:
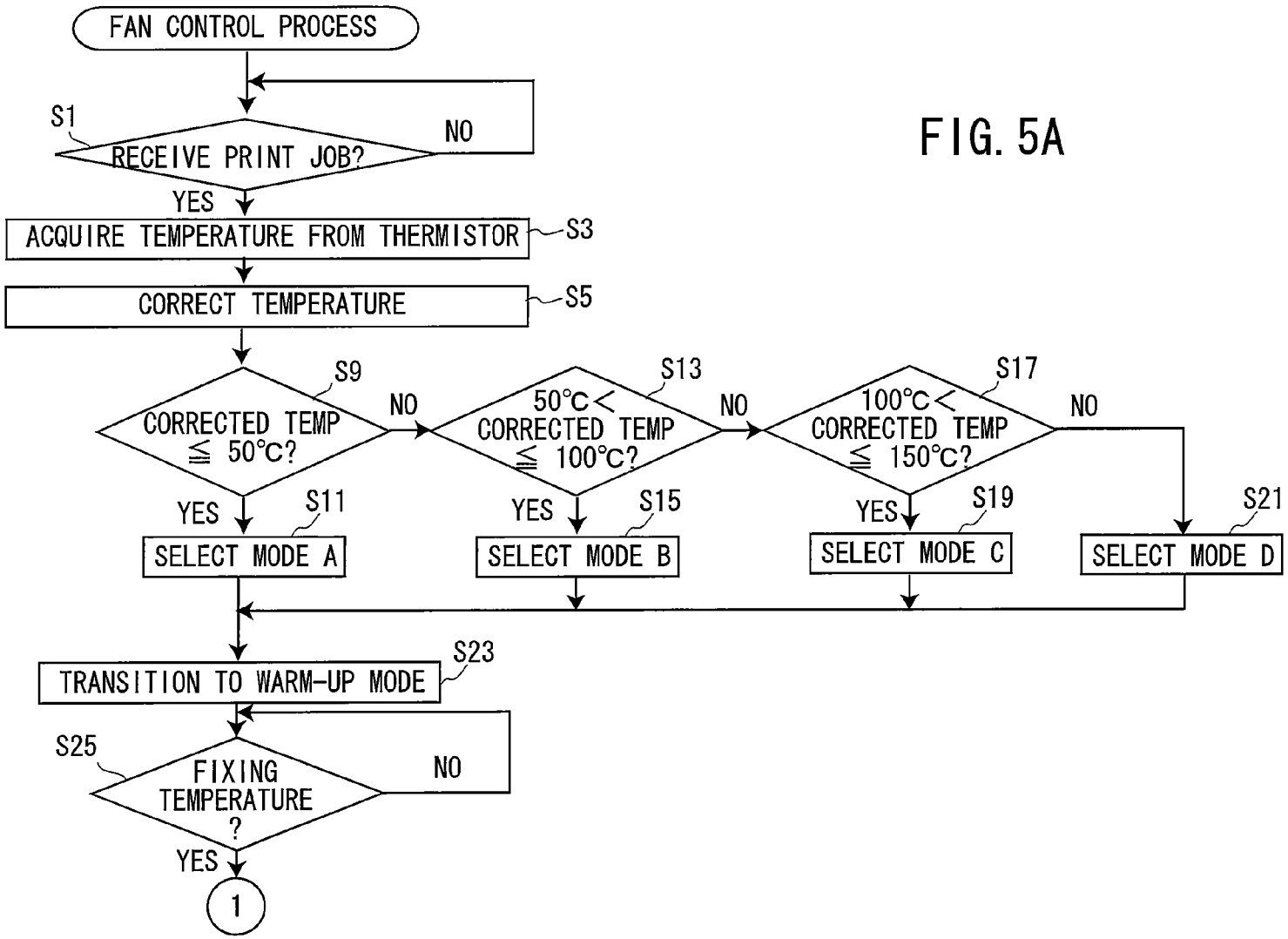
FIG. 5A is a flowchart illustrating a part of a fan control process according to the first embodiment.
Figure 5B:
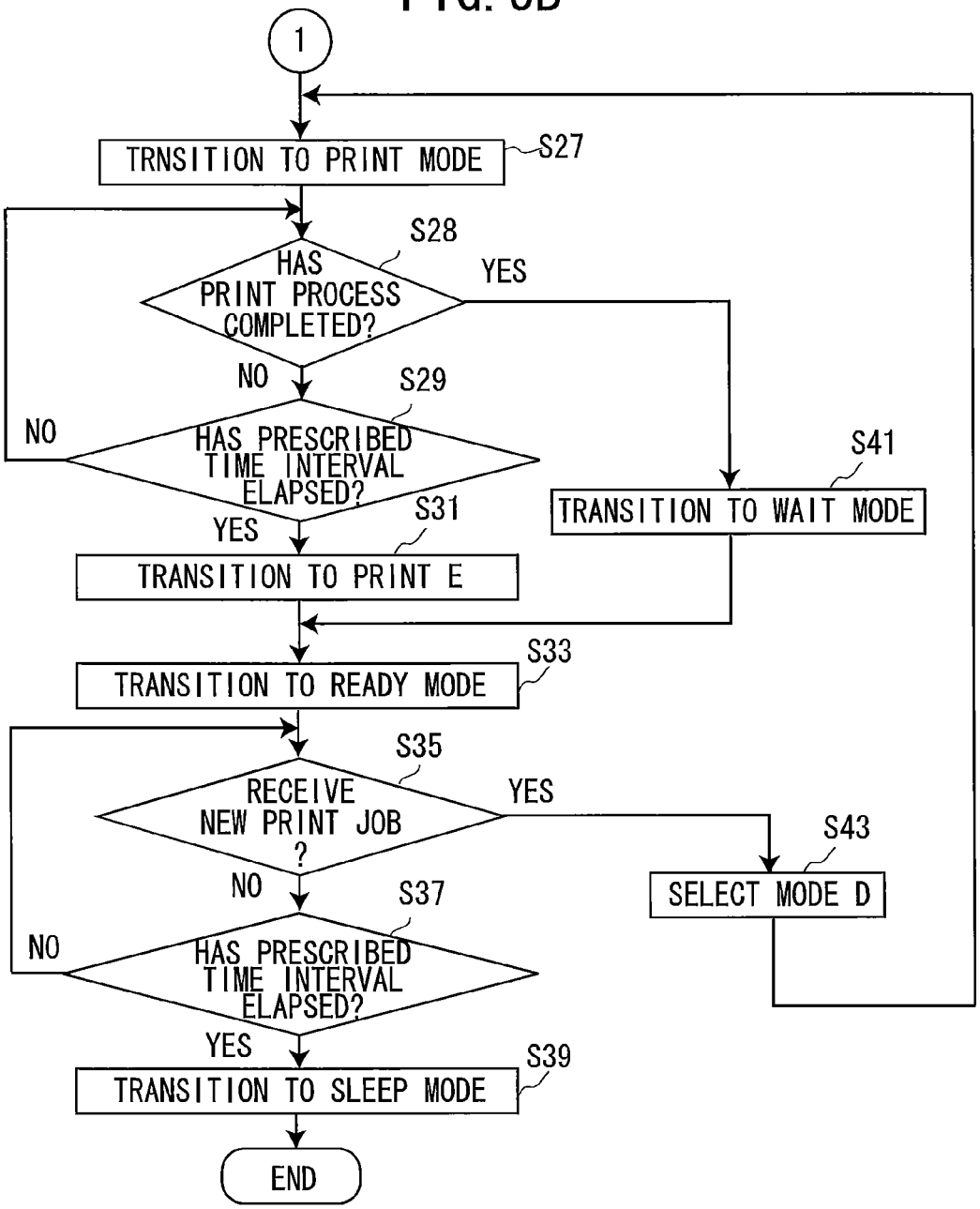
FIG. 5B is a flowchart illustrating a remaining part of the fan control process according to the first embodiment.

FIGS. 5A and 5B are flowcharts illustrating the fan control process shown in FIG. 4. The fan control process starts once the control unit 60 transitions to the sleep mode, that is, the control unit 60 is in the sleep mode when executing S1. In S1, the control unit 60 determines whether a print job (print command) is received or not. The print job is received via the communication unit 85, for example. In S3, the control unit 60 acquires a detected temperature T from the thermistor 79. In S5, the control unit 60 corrects the detected temperature T by the temperature correction formula assigned with the sleep mode (Z=1.1×T+2) described above, and thus obtains the corrected temperature Z. As described above, the fan control process starts once the control unit 60 transitions to the sleep mode. However, the fan control process may start once the control unit 60 transitions to the ready mode or the wait mode. In this case, the warm-up mode may start directly from the ready mode or the wait mode without executing the sleep mode. In other words, the control unit 60 is in the ready mode or the wait mode when executing S1.

Through the processes S9-S21, the control unit 60 selects a selection mode from modes A, B, C, and D based on the corrected temperature Z. The warm-up mode and the print mode will be executed according to the selected mode. For example, when the selection mode is set to the mode A, the warm-up mode state Warm-up A and the print mode state Print A will be executed in the subsequent processes.

Specifically, in S9, the control unit 60 determines whether the corrected temperature obtained in S5 is lower than or equal to 50° C. If the corrected temperature is lower than or equal to 50° C. (S9: YES), the control unit 60 sets the selection mode to the mode A (S11). If the corrected temperature is higher than 50° C. (S9: NO), in S13 the control unit 60 determines whether the corrected temperature is higher than 50° C., and lower than or equal to 100° C. If the corrected temperature is higher than 50° C., and lower than or equal to 100° C. (S13: YES), in S15 the control unit 60 sets the selection mode to the mode B. If the corrected temperature is higher than 100° C. (S13: NO), in S17 the control unit 60 determines whether the corrected temperature is higher than 100° C., and lower than or equal to 150° C. If the corrected temperature is higher than 100° C., and lower than or equal to 150° C. (S17: YES), in S19 the control unit 60 sets the selection mode to the mode C. If the corrected temperature is higher than 150° C. (S17: NO), the control unit 60 sets the selection mode to the mode D (S21).

After setting the selection mode in one of the processes S11, S15, S19, and S21, in S23 the control unit 60 transitions to a corresponding state of the warm-up mode (one of states Warm-up A-D) from the sleep mode, according to the determined selection mode. Here, the warm-up mode states Warm-up A, B, C, and D respectively correspond to the selection modes A, B, C, and D. Thus, in S23 the control unit 60 transitions to and executes one of the warm-up mode states Print A, B, C, and D corresponding to the current selection mode. In S25, the control unit 60 calculates a current corrected temperature Z by using the correction formula corresponding to the current warm-up mode state described above. Further, in S25 the control unit 60 determines whether the current corrected temperature Z reaches the fixing temperature (210° C., for example). The control unit 60 repeatedly executes the process S25 while the negative determination is made in S25.

If the current corrected temperature Z reaches the fixing temperature (S25: YES), in S27 the control unit 60 transitions to the print mode from the warm-up mode. Here, the print mode states Print A, B, C, and D respectively corresponds to the selection modes A, B, C, and D. In S27 the control unit 60 transitions to and executes one of the print mode states A, B, C, and D corresponding to the current selection mode. In the print mode, the control unit 60 executes the printing process based on the received print job.

In S28 the control unit 60 determines whether the printing process has completed or not. If the printing process has not been completed (S28: NO), in S29 the control unit 60 determines whether a prescribed time duration has elapsed. As described above, the prescribed time duration is set to 27 seconds for Print A, 22 seconds for Print B, 18 seconds for Print C, and 24 seconds for Print D. If the prescribed time duration has not elapsed (S29: NO), the control unit 60 returns to the process S28. If the prescribed time duration has elapsed (S29: YES), in S31 the control unit 60 transitions to Print E from the current print mode state. In Print E, the control unit 60 continues the printing process. If the printing process has been completed in Print E, the control unit proceeds to S33.

If the control unit 60 determines that the printing process has completed (S28: YES), in S41 the control unit 60 transitions to the wait mode. The wait mode states Wait A, B, C, and D respectively correspond to the selection modes A, B, C, and D. The control unit 60 transitions to and executes one of the wait mode states Wait A, B, C, and D corresponding to the current selection mode. The control unit 60 executes the wait mode for 30 seconds and subsequently proceeds to S33.

When the printing process has been completed in Print E of S31, or when 30 seconds has elapsed in the wait mode of S41, in S33 the control unit 60 transitions to and executes the ready mode. In S35 the control unit 60 determines whether a new print job has been received. If the new print job has been received (S35: YES), in S43 the control unit 60 sets the selection mode to the mode D and returns to S27. In this case, the new print job is executed in the print mode state Print D in S27.

If the new print job has not been received (S35: NO), in S37 the control unit 60 waits until a prescribed time interval (30 seconds, for example) has elapsed. If the prescribed time interval has elapsed (S37: YES), in S39 the control unit 60 ends the fan control process.

Since the control unit 60 can control the fan 50 based on the detection temperature of the thermistor 79, the printer 1 of the embodiment can resolve the conventional problem of fan operations affecting the fixing unit 40. Further, when the corrected temperature Z is lower than 150° C., serving as a threshold value, the control unit 60 drives the fan 50 at low speed for a prescribed time interval after the printing process has begun. This method reduces the time during which the fan 50 is operated at high speed and is a good means of noise control. On the other hand, when the corrected temperature Z is higher than the threshold value of 150° C., the control unit 60 drives the fan 50 at high speed following the start of the printing process, preventing the internal temperature of the printer 1 from rising above a temperature tolerance.

In the printer 1 of the embodiment, the prescribed time for driving the fan 50 at low speed is set based on the detection temperature of the thermistor 79 and, hence, can be set to a duration that is suitable for the detected temperature. Specifically, the execution time of Print A for cases in which the corrected temperature Z is lower than 50° C. is set to 27 seconds, the execution time of Print B for cases in which the corrected temperature Z is between 51° C. and 100° C. is set to 22 seconds, and the execution time of Print C for cases in which the corrected temperature Z is between 101° C. and 150° C. is set to 18 seconds. Thus, the duration at which the fan 50 is driven at low speed increases for lower corrected temperatures Z. Accordingly, the duration at which the fan 50 operates at high speed can be further reduced.

Further, since the printer 1 corrects the detection temperature of the thermistor 79 using a temperature correction formula, the printer 1 can correct the difference between the detection temperature of the thermistor 79 and the actual temperature of the fixing unit 40 in order to control the temperature of the fixing unit 40 with high precision.

Moreover, when the state of the printer 1 transitions in the sequence Warm-up A→Print A-1→Print A-2→Print A-3→Print E, for example, the temperature correction formula changes in the sequence $Z=1.5\times T-6 \rightarrow Z=1.4\times T-6 \rightarrow Z=1.4\times T-21 \rightarrow Z=1.3\times T-11 \rightarrow Z=1.2\times T-13$. Thus, the difference between the corrected temperature Z and the detection temperature corrected by the temperature correction formulae grows smaller the greater the amount of time that has elapsed after initially heating the fixing unit 40, making it possible to control the temperature of the fixing unit 40 with greater accuracy.

Further, if the detection temperature of the thermistor 79 is between 51° C. and 100° C. when the printer 1 receives a print job, for example, the control unit 60 uses the temperature correction formula $Z=1.5\times T-5$ to correct the detection temperature of the thermistor 79 during the warm-up mode. When the detection temperature of the thermistor 79 is between 101° C. and 150° C., the control unit 60 uses the temperature correction formula $Z=1.3\times T-20$ to correct the detection temperature during the warm-up mode. Hence, the temperature correction formulae used by the control unit 60 produce a greater difference between the corrected temperature Z and the detection temperature of the thermistor 79 for lower detection temperatures, making it possible to control the temperature of the fixing unit 40 with greater accuracy.

Next, a second embodiment of the present invention will be described with reference to the state transition diagram of FIG. 6.

Since the effects of external air on temperature measurements are stronger when the rear cover 3 is open, the difference between the detection temperature of the thermistor 79 and the actual temperature of the fixing unit 40 tends to be greater. Therefore, the control unit 60 in the second embodiment controls the fan at a constant speed after the start of a printing operation when the rear cover 3 is open.

More specifically, the control unit 60 detects whether the rear cover 3 is open based on an output signal received from the cover sensor 83. If the control unit 60 detects that the rear cover 3 is open before executing a printing operation, the control unit 60 controls the printer 1 based on the state transition diagram in FIG. 6. The dashed border in FIG. 6 indicates a high-speed region in which the control unit 60 drives the fan 50 at high speed. Thus, the fan speed is set to high during the print mode. Accordingly, while the rear cover 3 is open, the control unit 60 constantly controls the fan 50 at high speed during printing operations, regardless of whether the detection temperature of the thermistor 79 is higher or lower than the threshold value prior to the start of the printing operation.

Figure 6:
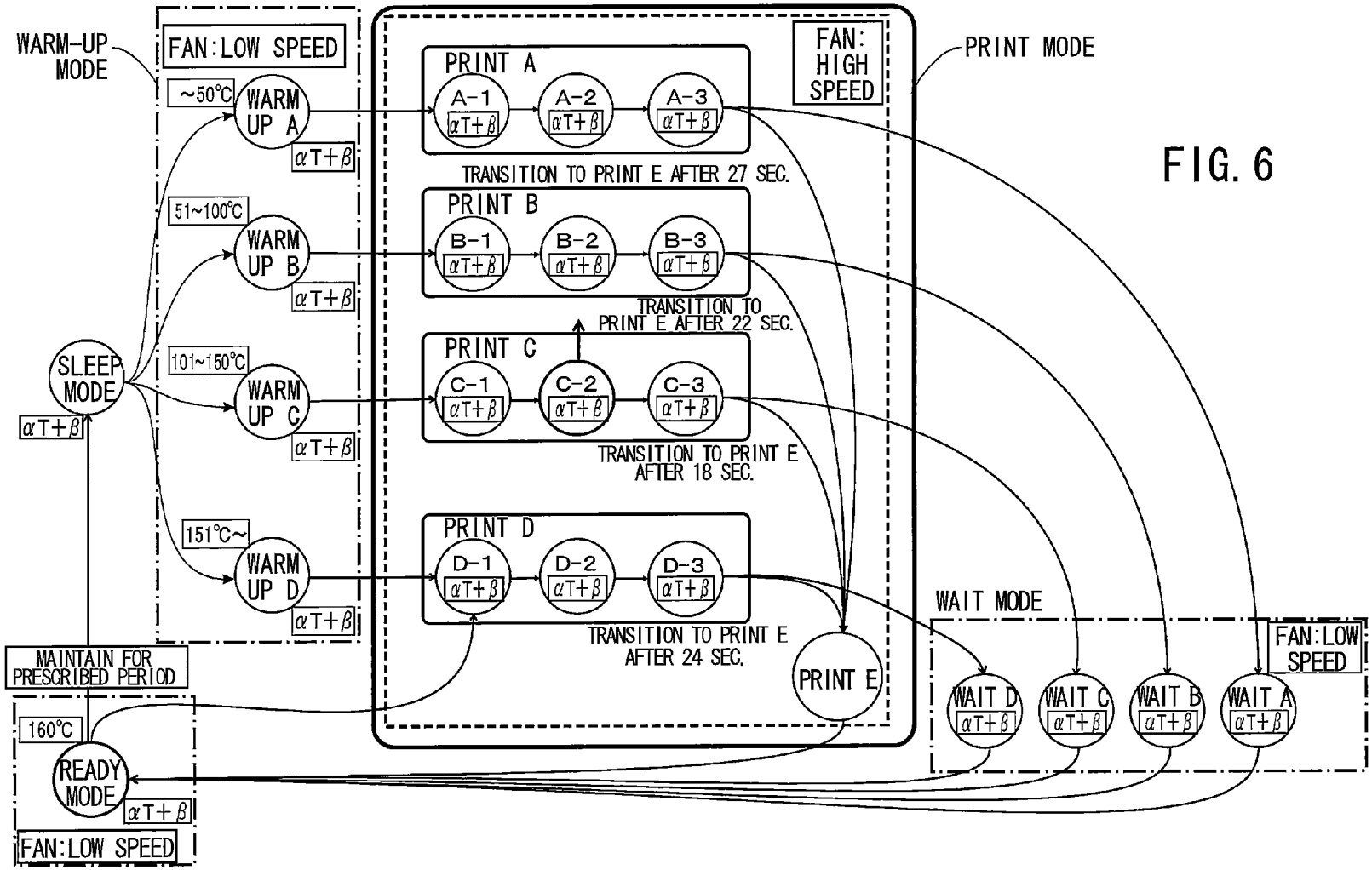
FIG. 6 is a printer state transition diagram according to a second embodiment.

Note that the fan speed is set to low for the ready mode, the wait mode, and the warm-up mode in FIG. 6, even when the rear cover 3 is open so as not to increase the time for driving the fan 50 at high speed more than necessary.

While the printer 1 according to the first embodiment described earlier uses temperature correction formulae to correct the detection temperature of the thermistor 79, the printer 1 according to the second embodiment employs two patterns of temperature correction formulae, with one pattern accounting for when the rear cover 3 is open and the other accounting for when the rear cover 3 is closed. The temperature correction formulae accounting for when the rear cover 3 is closed are employed for the states in the transition diagram of FIG. 4, while temperature correction formulae accounting for when the rear cover 3 is open are employed for the states in the transition diagram of FIG. 6. In FIG. 6, the correction formulae are shown by "$\alpha \times T+\beta$", but specific values of $\alpha$ and $\beta$ are not shown. However, these specific values of $\alpha$ and $\beta$ vary for each mode (warm-up A-D, and print A-1, A-2, for example) similarly to FIG. 4. So, in FIG. 6, the difference between the corrected temperature Z and the detection temperature corrected by the temperature correction formulae may grow smaller the greater the amount of time that has elapsed after initially heating the fixing unit 40. Further, the temperature correction formulae used by the control unit 60 may produce a greater difference between the corrected temperature Z and the detection temperature of the thermistor 79 for lower detection temperatures. In this way, the difference between the detection temperature of the thermistor 79 and the actual temperature of the fixing unit 40 can be corrected, even when the rear cover 3 is open, thereby controlling the temperature of the fixing unit 40 with high accuracy.

For example, when the printer 1 according to the second embodiment detects a change in the open/closed state of the rear cover 3 while executing a printing operation according to one state transition diagram, the printer 1 shifts to another state transition diagram and continues the printing process. For example, if the cover sensor 83 detects a change in the open/closed state of the rear cover 3 when the printer 1 is in the state Print C-2 in the transition diagram of FIG. 6, the control unit 60 transitions from Print C-2 in this state transition diagram to Print C-2 in the state transition diagram of FIG. 4 and continues to control the printer 1. By switching the state of the printer 1 between two state transition diagrams when a change in the open/closed state of the rear cover 3 is detected during a printing process in this way, it is possible to control the fixing unit 40 and the fan speed, thereby achieving a state that is optimal for the open/closed state of the rear cover 3.

Next, a third embodiment of the present invention will be described with reference to the state transition diagram of FIG. 7.

In the first embodiment described above, the control unit 60 drives the fan 50 at low speed for a prescribed time after the start of the printing operation when the detection temperature of the thermistor 79 prior to the start of the printing operation is lower than the threshold value. In the third embodiment, the duration for driving the fan 50 at low speed is set based on the printing speed of the printer 1.

More specifically, the printer 1 according to the third embodiment has two modes for printing speed, including a high-speed printing mode and a low-speed printing mode, and the user of the printer 1 is free to select a desired mode. The user may select a mode by performing an operation on an operating unit of the printer 1. For example, if the user has selected high-speed print as the mode of the printer 1 prior to executing a printing operation, the control unit 60 controls the printer 1 based on the state transition diagram in FIG. 4 described in the first embodiment. When the user has selected low-speed print, the control unit 60 controls the printer 1 according to the state transition diagram of FIG. 7.

In the high-speed printing mode, the printer 1 forms images on sheets S while conveying the sheets S at the highest possible speed. In the low-speed printing mode, the printer 1 forms images on sheets S while conveying the sheets S at one-half the speed of a high-speed print. During low-speed printing, the fixing temperature is kept lower than that during high-speed printing.

In the state transition diagram of FIG. 4, the execution time for Print A is set to a duration of 27 seconds. Accordingly, when the printer 1 is set to the high-speed printing mode and the corrected temperature Z obtained by correcting the detection temperature of the thermistor 79 prior to the start of the printing operation is less than or equal to 50° C., the control unit 60 drives the fan 50 at low speed for a duration of 27 seconds after the start of the printing operation, then switches the fan 50 to high speed once the 27 seconds have elapsed.

Figure 7:
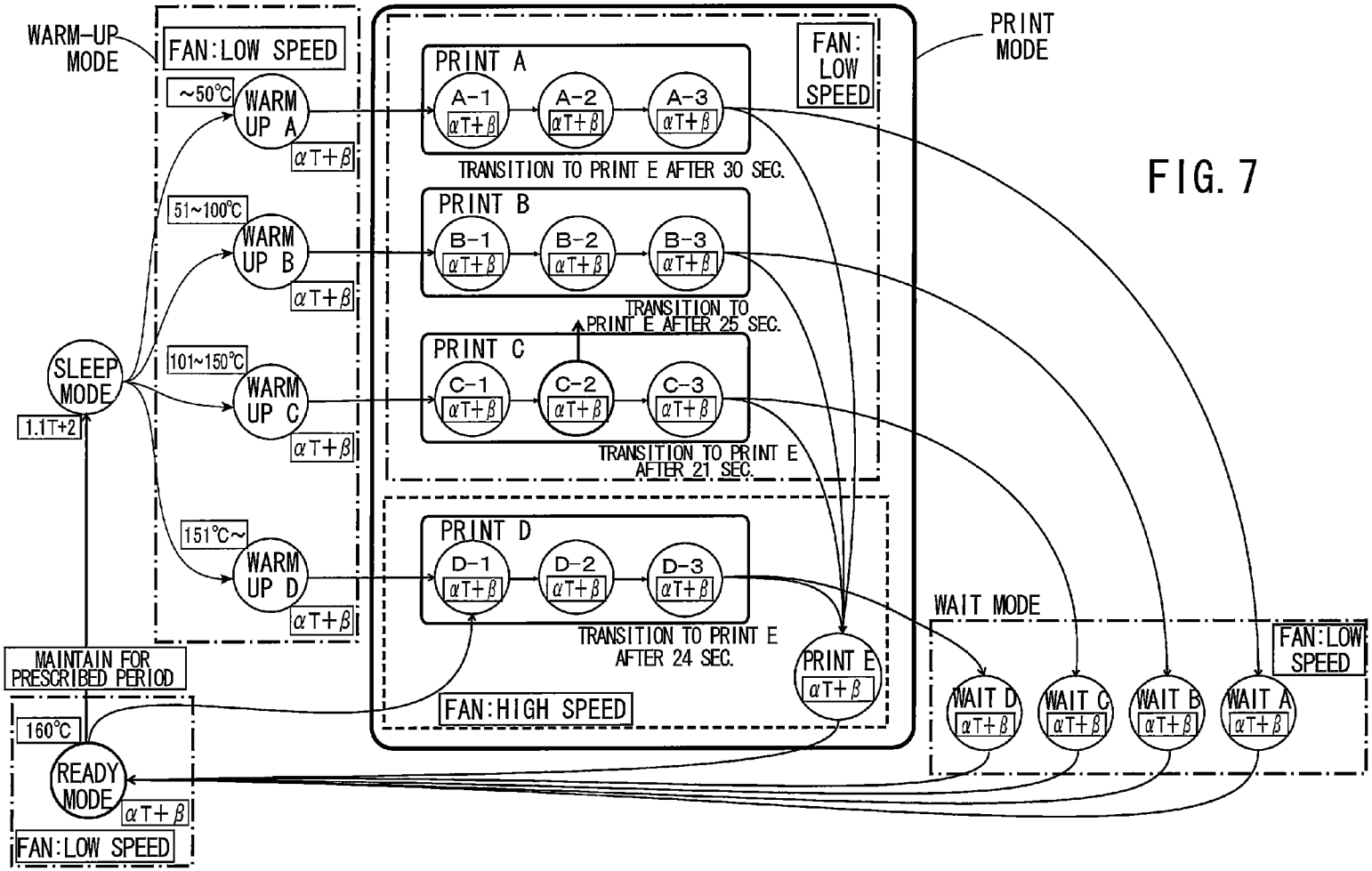
FIG. 7 is a printer state transition diagram according to a third embodiment.

On the other hand, in the state transition diagram of FIG. 7, the execution time for Print A is set to a duration of 30 seconds. Accordingly, when the printer 1 is set to the low-speed printing mode and the corrected temperature Z obtained by correcting the detection temperature of the thermistor 79 prior to the start of the printing operation is less than or equal to 50° C., the control unit 60 drives the fan 50 at low speed for a duration of 30 seconds after the start of the printing operation, then switches the fan 50 to high speed once the 30 seconds have elapsed.

In the state transition diagram of FIG. 4, the execution time for Print B is set to a duration of 22 seconds. Accordingly, when the printer 1 is set to the high-speed printing mode and the corrected temperature Z obtained by correcting the detection temperature of the thermistor 79 prior to the start of the printing operation is higher than or equal to 51° C. and less than or equal to 100° C., the control unit 60 drives the fan 50 at low speed for a duration of 22 seconds after the start of the printing operation, then switches the fan 50 to high speed once the 22 seconds have elapsed.

On the other hand, in the state transition diagram of FIG. 7, the execution time for Print B is set to a duration of 25 seconds. Accordingly, when the printer 1 is set to the low-speed printing mode and the corrected temperature Z obtained by correcting the detection temperature of the thermistor 79 prior to the start of the printing operation is higher than or equal to 51° C. and less than or equal to 100° C., the control unit 60 drives the fan 50 at low speed for a duration of 25 seconds after the start of the printing operation, then switches the fan 50 to high speed once the 25 seconds have elapsed.

In the state transition diagram of FIG. 4, the execution time for Print C is set to a duration of 18 seconds. Accordingly, when the printer 1 is set to the high-speed printing mode and the corrected temperature Z obtained by correcting the detection temperature of the thermistor 79 prior to the start of the printing operation is higher than or equal to 101° C. and less than or equal to 150° C., the control unit 60 drives the fan 50 at low speed for a duration of 18 seconds after the start of the printing operation, then switches the fan 50 to high speed once the 18 seconds have elapsed.

On the other hand, in the state transition diagram of FIG. 7, the execution time for Print C is set to a duration of 21 seconds. Accordingly, when the printer 1 is set to the low-speed printing mode and the corrected temperature Z obtained by correcting the detection temperature of the thermistor 79 prior to the start of the printing operation is greater than or equal to 101° C. and less than or equal to 150° C., the control unit 60 drives the fan 50 at low speed for a duration of 21 seconds after the start of the printing operation, then switches the fan 50 to high speed once the 21 seconds have elapsed.

In this way, the printer 1 according to the third embodiment sets the duration for driving the fan 50 at low speed based on the printing speed of the printer 1, making it possible to set the duration for driving the fan 50 at low speed to a time suited to the printing speed. That is, since the fixing temperature is lower in a low-speed print than in a high-speed print, the internal temperature of the printer 1 is less likely to rise during a low-speed print. Therefore, the duration at which the fan 50 is driven at low speed can be increased, thereby reducing the duration at which the fan 50 is driven at high speed.

The printer 1 according to the first embodiment described earlier corrects the detection temperature of the thermistor 79 using temperature correction formulae. In the third embodiment, the printer 1 employs two patterns of temperature correction formulae, including one pattern accounting for the high-speed printing state and one pattern accounting for the low-speed printing state. The pattern of temperature correction formulae accounting for the high-speed printing state is employed for each state in the transition diagram of FIG. 4, while the pattern of temperature correction formulae accounting for the low-speed printing state is employed for each state in the transition diagram of FIG. 7. In FIG. 7, the correction formulae are shown by "$\alpha \times T+\beta$", but specific values of $\alpha$ and $\beta$ are not shown. However, these specific values of $\alpha$ and $\beta$ vary for each mode (warm-up A-D, and print A-1, A-2, for example) similarly to FIG. 4. So, in FIG. 7, the difference between the corrected temperature Z and the detection temperature corrected by the temperature correction formulae may grow smaller the greater the amount of time that has elapsed after initially heating the fixing unit 40. Further, the temperature correction formulae used by the control unit 60 may produce a greater difference between the corrected temperature Z and the detection temperature of the thermistor 79 for lower detection temperatures. Hence, the printer 1 according to the third embodiment can correct the difference between the detection temperature of the thermistor 79 and the actual temperature of the fixing unit 40, whether the printing speed is high or low, thereby controlling the temperature of the fixing unit 40 with great accuracy.

Further, if the printing speed of the printer 1 is changed during a printing operation, for example, the printer 1 according to the third embodiment can continue the printing operation while shifting to another state transition diagram. For example, if the printing speed is modified while the printer 1 is in state Print C of the state transition diagram shown in FIG. 7, the control unit 60 can switch the state of the printer 1 from state Print C-2 in the transition diagram of FIG. 7 to state Print C-2 in the transition diagram of FIG. 4 and continue controlling the printer 1.

While the invention has been described in detail with reference to the embodiments thereof, it would be apparent to those skilled in the art that various changes and modifications may be made therein without departing from the scope of the invention.

(1) When the corrected temperature based on the detection temperature of the thermistor 79 is less than a threshold value in the first embodiment, the control unit 60 drives the fan 50 at one-half its maximum speed for a prescribed time following the start of a printing operation. However, the fan speed during this prescribed time interval may be set to a speed other than one-half the maximum fan speed, such as one-fourth or one-third the maximum speed, provided that the fan speed is set slower than the speed used after the prescribed time has elapsed. Alternatively, the fan speed may be set to zero, i.e., the fan may be halted during this prescribed time.

(2) In the first embodiment, a non-contact thermistor is used as an example of the temperature-detecting unit, but a contact thermistor may also be used.

(3) In the first embodiment, the detection temperature of the thermistor 79 is corrected using a temperature correction formula, but it is not necessary to perform temperature correction. That is, the control unit 60 may determine whether or not to drive the fan 50 at low speed by comparing the detection temperature of the thermistor 79 prior to the start of a printing operation with a threshold value.

(4) In the first embodiment, the control unit 60 includes the CPU 61, the ROM 63, and the RAM 65. However, the control unit 60 may include one or more hardware circuit such as an application specific integrated circuits (ASIC) in place of the CPU 61. Or, the control unit 60 may be configured of a combination of at least one CPU and at least one hardware circuit.

(5) The correction formulae are not limited to the formulae explained in the above embodiments. For example, the correction formulae are given by "$\alpha \times T+\beta$", that is, the correction formulae are proportional to the temperature T. However, the correction formulae may not be proportional to the temperature T.

Further, the correction formulae for some modes may be set such that the lower the detected temperature is, the greater a difference between the detected temperature and the corrected temperature is. Or, the correction formulae for some modes may be set such that the longer an elapsed time from a moment when the fixing unit 40 starts generating heat, the smaller a difference between the detected temperature and the corrected temperature is.

(6) In the embodiments, the warm-up mode starts when a print job is received in the sleep mode. However, the warm-up mode may start when a print job is received in the ready mode. In this case, the control unit 60 skips the sleep mode and executes the warm-up mode directly from the ready mode. Further, when a print job is received in the wait mode, the control unit 60 may skip the ready mode and the sleep mode and start the warm-up mode directly from the wait mode.

(7) Any configurations of the above embodiments can be combined appropriately.

What is claimed is:

1. An image-forming apparatus comprising:

a fan;

an image-forming portion configured to perform a printing operation in which an image is formed on a sheet;

a heater configured to thermally fix the image on the sheet;

a detector configured to detect a temperature of the heater; and a processor configured to:

determine whether the temperature detected by the detector is higher than a threshold value before the image-forming portion performs the printing operation;

drive the fan at a first speed following start of the printing operation when the temperature is higher than the threshold value; and drive the fan at a second speed lower than the first speed for a prescribed period of time following the start of the printing operation when the temperature is lower than the threshold value or equal to the threshold value, and subsequently drive the fan at the first speed;

control a temperature of the heater based on the temperature detected by the detector while the image-forming portion performs the printing operation.

2. The image-forming apparatus according to claim 1, wherein the processor is further configured to set the prescribed period of time based on the temperature detected before the start of the printing operation.

3. The image-forming apparatus according to claim 1, wherein the processor is further configured to set the prescribed period of time based on a printing speed of the image-forming portion.

4. The image-forming apparatus according to claim 1, wherein the detector includes a non-contact temperature sensor configured to detect the temperature of the heater without contact.

5. The image-forming apparatus according to claim 4, wherein the processor is further configured to:

change the detected temperature to a corrected temperature by using a selected one of a plurality of temperature correction formulae that is selected depending upon the detected temperature; and control a temperature of the heater based on the corrected temperature.

6. The image-forming apparatus according to claim 5, wherein the temperature correction formula is set such that the lower the detected temperature is, the greater a difference between the detected temperature and the corrected temperature is.

7. The image-forming apparatus according to claim 5, wherein the temperature correction formula is set such that the longer an elapsed time from a moment when the heater starts generating heat, the smaller a difference between the detected temperature and the corrected temperature is.

8. The image-forming apparatus according to claim 1, further comprising:

a casing; and a cover configured to selectively cover and expose at least a part of the casing, wherein the processor is further configured to drive the fan at a constant speed following the start of the printing operation when the cover exposes the at least a part of the casing.

9. The image-forming apparatus according to claim 1, further comprising a casing, wherein the fan controls an internal temperature of the casing.

10. The image-forming apparatus according to claim 1, wherein the image-forming portion configured to perform a printing operation based on a print job;

wherein the processor is further configured to:

receive a print job;

determine whether the print job is received or not; and obtain the temperature detected by the detector in response to determine that the print job is received.

11. An image-forming apparatus comprising:

a fan configured to drive at a first speed and a second speed that is lower than the first speed;

an image-forming portion configured to perform a printing operation in which an image is formed on a sheet;

a heater configured to heat the image on the sheet;

a non-contact temperature detector configured to detect a temperature of the heater without contact; and a processor configured to:

drive the fan at the second speed for a prescribed period of time following the start of the printing operation and subsequently drive the fan at the first speed;

obtain the temperature detected by the non-contact temperature detector when the fan drives; and control a temperature of the heater based on the obtained temperature.

12. The image-forming apparatus according to claim 11, wherein the processor is further configured to set the prescribed period of time based on the temperature detected before the start of the printing operation.

13. The image-forming apparatus according to claim 12, wherein the higher the temperature is, the shorter the prescribed period of time is.

14. The image-forming apparatus according to claim 12, wherein the image-forming portion is further configured to include a first-speed printing mode and a second-speed printing mode, a printing speed of the second-speed printing mode being slower than a printing speed of the first-speed printing mode;

the prescribed period of time in the first-speed printing mode is shorter than the prescribed period of time in the second-speed printing mode.

15. An image-forming apparatus comprising:

a fan configured to drive a first speed or a second speed that is slower than the first speed;

an image-forming portion configured to perform a printing operation in which an image is formed on a sheet;

a heater configured to heat the image on the sheet;

a detector configured to detect a temperature of the heater;

a memory configured to store a temperature correction formula; and a processor configured to:

obtain a speed of the fan;

obtain a temperature correction formula from the memory based on the speed of the fan;

correct the temperature to a corrected temperature by using the obtained temperature correction formula; and control a temperature of the heater based on the corrected temperature.

16. The image-forming apparatus according to claim 15, wherein the temperature correction formula is set such that the lower the detected temperature is, the greater a difference between the temperature and the corrected temperature is.

17. The image-forming apparatus according to claim 15, wherein the temperature correction formula is set such that the longer an elapsed time from a moment when the heater starts generating heat, the smaller a difference between the temperature and the corrected temperature is.

* * * * *